US011408213B2

(12) United States Patent
Lai

(10) Patent No.: US 11,408,213 B2
(45) Date of Patent: Aug. 9, 2022

(54) LOCKING SYSTEM FOR A SECURE SAFE

(71) Applicant: FOCUS-ON TOOLS, Hangzhou (CN)

(72) Inventor: Yue Jiang Lai, Hangzhou (CN)

( * ) Notice: Subject to any disclaimer, the term of this patent is extended or adjusted under 35 U.S.C. 154(b) by 196 days.

(21) Appl. No.: 16/931,952

(22) Filed: Jul. 17, 2020

(65) Prior Publication Data

US 2022/0018169 A1 Jan. 20, 2022

(51) Int. Cl.

| | |
|---|---|
| ***E05C 9/04*** | (2006.01) |
| ***E05G 1/04*** | (2006.01) |
| ***E05B 65/00*** | (2006.01) |
| ***E05C 9/00*** | (2006.01) |
| ***E05C 9/06*** | (2006.01) |
| ***E05C 9/12*** | (2006.01) |
| ***E05C 1/00*** | (2006.01) |
| ***E05B 79/14*** | (2014.01) |
| ***E05C 1/06*** | (2006.01) |

(52) U.S. Cl.

CPC ..... *E05C 9/047* (2013.01); *E05B 65/0075* (2013.01); *E05C 1/006* (2013.01); *E05C 9/006* (2013.01); *E05C 9/063* (2013.01); *E05C 9/12* (2013.01); *E05G 1/04* (2013.01); *E05B 79/14* (2013.01); *E05C 1/06* (2013.01); *E05C 9/04* (2013.01); *E05C 9/042* (2013.01); *Y10T 70/5279* (2015.04); *Y10T 292/0834* (2015.04); *Y10T 292/0836* (2015.04); *Y10T 292/0837* (2015.04); *Y10T 292/0839* (2015.04); *Y10T 292/0962* (2015.04); *Y10T 292/0966* (2015.04); *Y10T 292/0993* (2015.04); *Y10T 292/1018* (2015.04)

(58) Field of Classification Search

CPC ..... E05B 83/30; E05B 79/14; E05B 85/08; E05B 83/28; E05B 65/0075; E05C 9/04; E05C 9/047; E05C 9/006; E05C 9/063; E05C 9/12; E05C 1/006; E05C 1/02; E05C 9/042; E05C 1/06; E05Y 2201/686; E05Y 2900/538; Y10T 292/0834; Y10T 292/0962; Y10T 292/0836; Y10T 292/0837; E05G 1/04

USPC ..... 70/120

See application file for complete search history.

(56) References Cited

U.S. PATENT DOCUMENTS 97,581 A * 12/1869 Worrell et al. ..... E05B 65/0075 70/118
165,752 A * 7/1875 Brooks et al. ..... E05C 19/001 292/40
184,680 A * 11/1876 Whitson et al. ..... E05B 63/14 70/120
267,398 A * 11/1882 Black ..... E05B 7/00 292/153
305,684 A * 9/1884 Ewing ..... E05B 59/00 70/108
341,728 A * 5/1886 Caron ..... E05B 65/0075 70/399

(Continued)

*Primary Examiner* — Christine M Mills
*Assistant Examiner* — Faria F Ahmad
(74) *Attorney, Agent, or Firm* — Fulwider Patton LLP

(57) ABSTRACT

A locking system for securing, within a rectangular frame aperture of a safe, a hinged door having a perimeter and an external side and an internal side and occupying a first vertical plane, the door being configured for suspension on hinges. The locking system comprises a key axle, a disc, a plate. When the key axle is rotated the disc is caused to rotate and the plate slides horizontally to extend a distal end of the plate towards beyond the door perimeter.

4 Claims, 4 Drawing Sheets

(56) References Cited

U.S. PATENT DOCUMENTS 356,547 A * 1/1887 Pillard ..... E05B 65/0075 292/33
430,072 A * 6/1890 Dowd ..... E05B 65/0075 70/120
519,687 A * 5/1894 Johnston ..... E05B 63/20 292/39
930,328 A * 8/1909 Wilkinson ..... E05C 9/045 292/37
1,035,531 A * 8/1912 Cobb ..... E05C 9/041 292/39
1,075,914 A * 10/1913 Hoes ..... E05C 9/06 70/108
1,097,902 A * 5/1914 Zappile ..... E05B 63/14 70/120
1,152,776 A * 9/1915 Wolfe ..... E05B 53/003 70/145
1,157,978 A * 10/1915 Ezykowich ..... E05C 9/06 70/120
1,179,731 A * 4/1916 McDonald ..... E05B 63/20 70/324
1,341,038 A * 5/1920 Bickel ..... E05C 9/021 70/120
1,420,910 A * 6/1922 Collier ..... E05C 9/048 70/108
1,504,176 A * 8/1924 Wright ..... E05C 9/04 70/120
2,473,065 A * 6/1949 Miller ..... E05C 9/06 292/37
2,594,253 A * 4/1952 Vander Veer ..... B60J 9/02 292/181
3,396,999 A * 8/1968 Knapp ..... E05B 47/0002 292/144
3,990,278 A * 11/1976 Perelson ..... E05C 9/06 70/120
3,991,595 A * 11/1976 Bahry ..... E05C 9/14 70/120
4,037,440 A * 7/1977 Shabtai ..... E05C 9/06 70/120
4,154,070 A * 5/1979 Bahry ..... E05C 9/06 70/120
4,306,432 A * 12/1981 Ravid ..... E05C 9/14 70/120
4,362,034 A * 12/1982 Amgar ..... E05C 9/16 70/120
4,534,192 A * 8/1985 Harshbarger ..... E05C 9/16 292/335
4,616,864 A * 10/1986 Douglas ..... E05C 9/046 292/336.3
4,973,091 A * 11/1990 Paulson ..... E05C 9/042 292/216
4,984,832 A * 1/1991 Canepa ..... E05C 9/06 292/51
5,094,483 A * 3/1992 James ..... E05B 65/0075 109/59 R
5,245,846 A * 9/1993 James ..... E05B 65/0078 109/59 R
5,513,505 A * 5/1996 Dancs ..... E05B 65/1086 292/DIG. 60
5,632,166 A * 5/1997 Wiersma ..... E05C 9/048 70/120
5,709,111 A * 1/1998 Henao ..... E05B 15/108 70/120
5,778,708 A 7/1998 Crosby et al.
5,865,479 A * 2/1999 Viney ..... E05C 9/041 70/DIG. 42
5,911,763 A * 6/1999 Quesada ..... E05C 9/06 70/108
6,030,019 A * 2/2000 Stiltner ..... B62D 33/037 70/120
6,101,764 A 8/2000 Guy-Paul
6,283,516 B1 * 9/2001 Viney ..... E05B 15/004 292/160
6,319,479 B1 11/2001 Houston
6,478,345 B1 * 11/2002 Viney ..... E05C 9/047 70/108
6,490,895 B1 12/2002 Weinerman et al.
6,705,136 B2 * 3/2004 Porter ..... G07C 9/00182 70/279.1
7,036,852 B2 * 5/2006 Cho ..... E05B 83/30 292/160
7,387,076 B2 6/2008 Bauman et al.
7,490,562 B2 * 2/2009 Cornilleau ..... A63B 67/04 108/170
7,824,116 B2 * 11/2010 Lyman ..... B41J 3/4075 400/613
7,832,239 B2 * 11/2010 Kozuka ..... E05C 9/00 292/41
8,056,941 B2 * 11/2011 Segev ..... E05B 63/16 292/160
8,276,527 B2 10/2012 Stepp
8,347,665 B2 * 1/2013 Rasmussen ..... E05B 65/0075 70/91
8,590,351 B2 * 11/2013 Ookawara ..... E05C 9/047 292/37
8,763,836 B2 * 7/2014 Becklin ..... A44B 11/10 292/172
10,669,755 B2 * 6/2020 Ritzert ..... E05B 63/146
11,008,788 B2 * 5/2021 Brown ..... E05B 67/38
2004/0066046 A1 * 4/2004 Becken ..... E05B 63/20 292/39
2005/0104380 A1 * 5/2005 Cho ..... E05B 83/30 292/33
2011/0309640 A1 * 12/2011 Matsubara ..... E05B 63/248 292/159
2017/0275922 A1 * 9/2017 Zeus ..... E05C 9/1891
2019/0218834 A1 * 7/2019 Komatsu ..... E05B 77/44

* cited by examiner

LOCKING SYSTEM FOR A SECURE SAFE

CROSS-REFERENCES TO RELATED APPLICATIONS

Background

This disclosure relates generally to the field of firearm security safes and vaults and, more particularly, to improvements in safe or vault door locking systems Security safes for home and commercial use, and for the storage of firearms and other valuables, are well known. Typical safes are constructed to form a rectangular box having a hollow interior space used for storage and protection of items such as firearms. A security door is hingedly attached to either a top or side panel of a safe's rectangular frame to provide access to the interior space and to protect the safe from unwanted intrusion. Security doors are constructed with enhanced security features, such as multiple locking bolts or pins that simultaneously project from or retract into one or more sides of the door. The terms locking bolts and locking pins are used interchangeably herein. Such doors generally comprise a metal frame that forms the sides of the door ("door panel frame") through which locking bolts or pins protrude behind the frame of the safe body ("safe body frame") to secure the door in a locked position. Many such security doors utilize complicated configurations of camming grooves, pin followers and pivotally linked bars to simultaneously move the multiple bolts. See, e.g., U.S. Pat. No. 5,111,674 to Huang, U.S. Pat. No. 5,096,238 to Mintz, U.S. Pat. No. 4,470,277 to Uyeda.

Firearm safes are generally rectangular in shape and have a hinge-mounted door that provides access to the safe's interior compartment(s). The door is situated in a rectangular frame at the front of the safe. To provide security, the door is fitted with a locking system on an interior surface of the door. Typically, the door is provided with an interior panel that covers the locking mechanism, and sometimes provides additional gun safe features such as a rifle rack or storage pockets, for example, as shown and described in U.S. Pat. No. 7,409,790 entitled "Gun Safe Door Storage System."

It has been found that a common form of unauthorized entry into a safe is to pry the door open using the space between the door panel frame and the safe body frame, which is typically quite small. The larger the gap between the safe body frame and the door panel frame, the easier it is to get pry tools into the gap.

If the door panel frame and safe body frame are not of sufficient strength or configuration, or the locking mechanism is not sufficiently strong, the door panel frame may be pried away from the safe body frame.

Prior art safes have utilized locking pins that extend vertically, upwards at the top and downwards at the bottom, along the centerline of the door, in combination with a locking plate that extend horizontally along the horizontal centerline of the door to improve resistance to pry attacks. Such horizontally extending plates function by swinging to a closed position while extended outwardly beyond the door. The plates swing into a space in the frame defined by the safe. Once the door is in closed position, the key is turned and the horizontally extending plate is moved downwards so that it is located behind a vertically extending cantilevered portion of metal in the frame. The key is then removed.

However, tests have shown that under conditions of a prying action being used against the door, such vertically cantilevered portions of metal are fairly easy to bend out of the way, allowing a weakness in the door to develop.

Thus, there exists a need to provide a cost effective locking system for safe doors, that uses minimal parts, and is easy to manufacture, assemble, repair and maintain. The present invention addresses these and other needs.

SUMMARY OF THE INVENTION

In a preferred embodiment, the invention is a locking system for securing, within a rectangular frame aperture of a safe, a hinged door having a perimeter and an external side and an internal side and occupying a first vertical plane, the door being configured for suspension on hinges. The locking system comprises a key axle having an external end and an internal end, and extending through an aperture in the door perpendicularly to the vertical plane. A disc occupying a second vertical plane is provided, and is fixedly mounted at the internal end of the key axle, the disc having a first perimeter defining a first set of teeth. A plate occupying a third vertical plane is provided, and is mounted to the internal side of the door such as to allow the plate to slide horizontally and extend a distal end of the plate towards beyond the door perimeter, wherein the plate defines an aperture having a second perimeter sized to receive the first perimeter of the disc, and also wherein the second vertical plane of the disc lies within the aperture so that the second vertical plane is co-planar with the third vertical plane. Under this configuration, a portion of the second perimeter defines a second set of teeth configured to mate with the first set of teeth. An upper linking arm and a lower linking arm are provided, wherein a first end of the upper linking arm is attached by pinned connection to the disc and a first end of the lower linking arm is attached by pinned connection to the disc. An upper locking pin and a lower locking pin are provided, wherein a second end of the upper linking arm is operably connected to the upper locking pin, and a second end of the lower linking arm is operably connected to the lower locking pin. As a consequence of this configuration, when the key axle is rotated the disc is caused to rotate and (a) the first set of teeth engage with the second set of teeth so that the plate slides horizontally to extend the distal end of the plate towards beyond the door perimeter, and also (b) the upper linking arm and the lower linking arm are caused to move away from the disc, thereby to extend the upper locking pin and the lower locking pin towards beyond the door perimeter.

In some embodiments, the locking system is encased between an inner reinforcing plate and an outer reinforcing plate. In further embodiments, the inner reinforcing plate and the outer reinforcing plate respectively are each riveted to the door. In yet further embodiments, the upper locking pin and the lower locking pin respectively each pass through an aperture formed in a horizontally extending stabilizing plate that is attached to the door.

Other objects, features and advantages of the present invention will be apparent when the disclosure is considered in conjunction with the drawings set forth herein, which should be construed in an illustrative and not limiting sense.

BRIEF DESCRIPTION OF THE DRAWINGS

The present invention is described in detail below with reference to the attached drawing figures, wherein.

Reference will hereinafter be made to the drawings in which similar elements in different drawings bear the same reference numerals.

DETAILED DESCRIPTION OF THE PREFERRED EMBODIMENTS

In the following detailed description, certain preferred embodiments are described in order to provide a thorough understanding of the present invention. Those methods, procedures, components, or functions which are commonly known to persons of ordinary skill in the field of the invention are not described in detail as not to unnecessarily obscure a concise description of the present invention. Certain specific embodiments or examples are given for purposes of illustration only, and it will be recognized by one skilled in the art that the present invention may be practiced in other analogous applications or environments and/or with other analogous or equivalent variations of the illustrative embodiments.

General Construction

Figure 9:
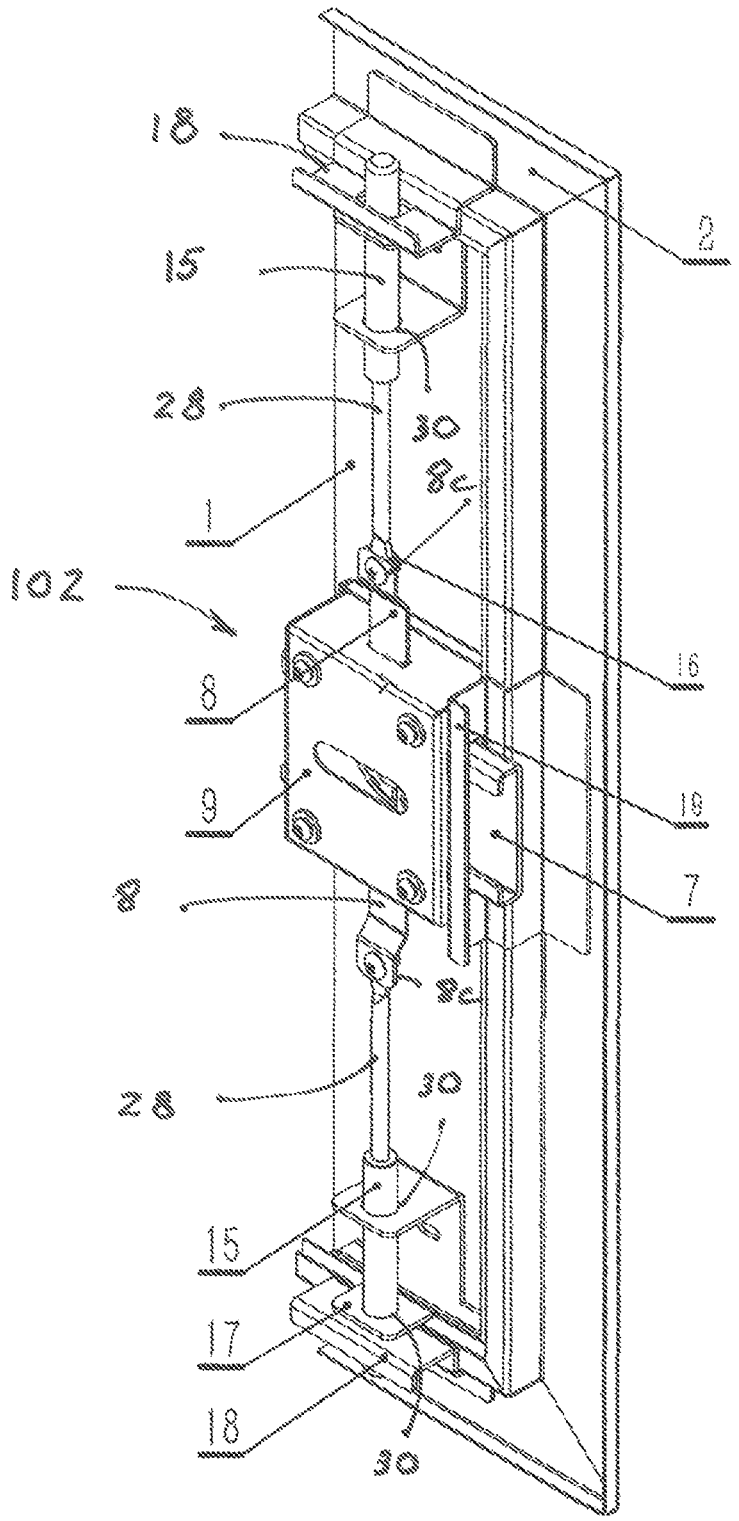
FIG. 9 is a perspective view of the locking system of the present invention in an assembled condition and attached to a door.

A door generally identified by reference numeral 1 used for sealing a safe or gun cabinet is shown in FIG. 9. The door 1, of a kind known in the art, is adapted for being hingedly connected to a safe body. (The safe body and hinges are not shown in the Figures.) The safe body, of a kind known in the art, has a frame, known in the art, sized for receiving the door in a closed condition. The frame is defined by the safe body as a rectangular opening by an upper and a lower horizontal lintel, and a left and a right vertical post. Together the lintels and the posts outline the frame. The size of the frame is configured to tightly receive the door, with as small a space as possible between the door and the frame. The door supports, on an inner surface of the door, a locking system generally referred to by numeral 102 which is activated by an external key, configured to electively lock the door into the frame or to unlock it.

The locking system 102 will be here described in relation to the door 1. As seen in FIG. 9, the locking system comprises an upper level locking pin 15 and also a lower level locking pin 15. Each locking pin 15 is vertically oriented. Each vertical locking pin 15 passes slidingly through an alignment aperture in each of a plurality of horizontally extending stabilizing plates which are attached to the door 1. For example, stabilizing plates 17 have the form of a U clip and are welded or bolted onto the door 1. Stabilizing plates 18 have a complex bent shape and are bolted or welded onto the door 1.

Each horizontally extending stabilizing plate defines an aperture 30 through which an upper locking pin 15 or a lower locking pin 15 passes. Thus, the various stabilizing plates constrain the locking pins 15, and prevent them from being separated horizontally away from the door 1. At the extremity of each vertical locking pin, the pin is sized to pass into a mating hole in the horizontal lintel (upper or lower lintel) of the frame of the safe (frame of the safe not shown in the figures). It will be appreciated that, when the locking pins 15 pass into the hole in the horizontal lintel of the frame, then the door is locked into the frame and, if the holes are strongly reinforced and the pins 15 are strongly constructed, the door is held in the frame.

As discussed above, however, the presence of two vertical locking pins 15 inserted into the upper and lower lintels of the frame still leaves the center of the door vulnerable to being prized open in the event that a prying tool can be inserted between the door and the door frame at the center of the vertical edge of the door.

Thus, a new and advantageous structure comprising a movable horizontal plate 7 is provided to introduce a secure locking restraint at the center of the door. As discussed above, it is known in the prior art to introduce a locking plate in the center of the door, but such known locking plates are configured to be held initially stationary and extended in relation to the door and then to be swung horizontally, together with the door, into a space in the vertical post of the frame when the door is swung closed. Thereafter, when the door is stationarily positioned within the frame, such horizontally extending plate is configured to be moved in a vertical direction (either upward or downward, in relation to the door), thus to secure the plate behind a cantilevered strip of metal in the vertical post. The disadvantage in this system, however, is that such cantilevered piece of metal is vulnerable to being bent by a prying tool should such be insertable between the door and the frame.

In contrast to the prior art, the present invention supplies a locking plate 7 that is advantageously and novelly configured to be in an initially horizontally withdrawn condition when the door is swung closed into the frame. Such is exemplified in FIG. 2B. Then, when the door is swung closed and positioned in the frame, the plate 7 is advanced directly and horizontally away from the door (as exemplified in FIG. 2A) and into a circumscribed opening in the vertical post of the door frame (post and frame not shown in the figures). This configuration eliminates the use of a cantilevered strip of metal in the door frame which is relatively easy to deform and bend. The circumscribed opening for receiving the plate 7 is more difficult to deform because of the action of ring tension in the behavior of the circumscribed opening.

Figure 1:
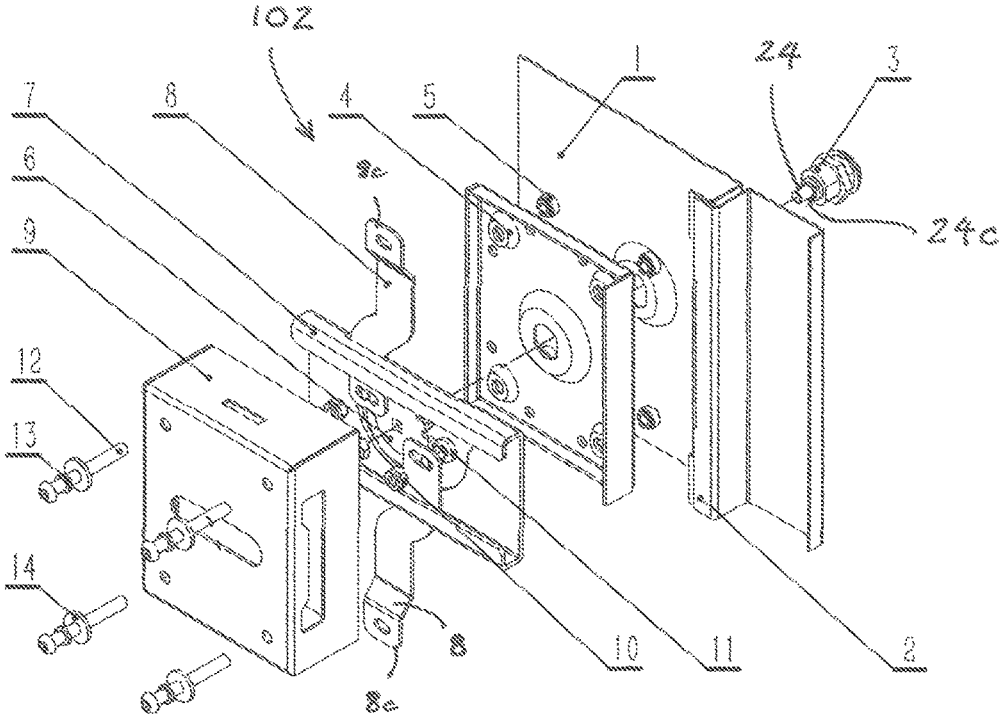
FIG. 1 is a vertical perspective view, shown in exploded composition, of components of the locking system of the present invention.
Figure 2A:
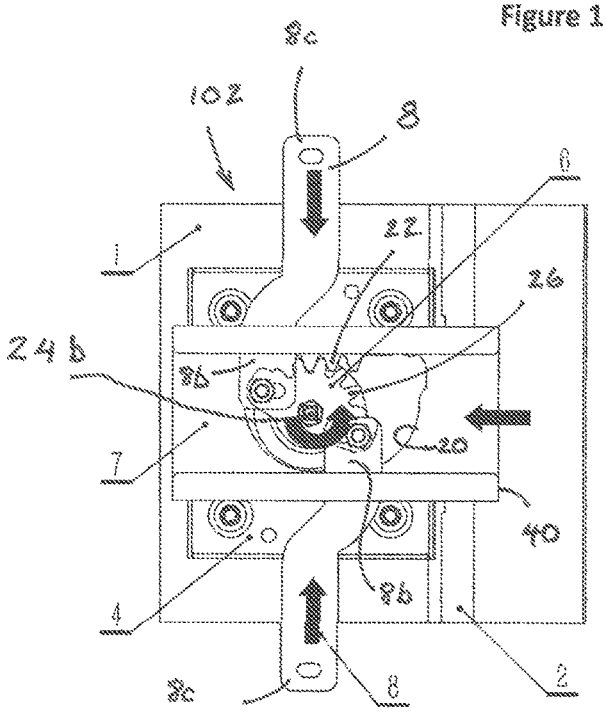
FIG. 2A is a rear plan view of the locking system of FIG. 1, shown in a first condition in which the system is in a locking condition.
Figure 2B:
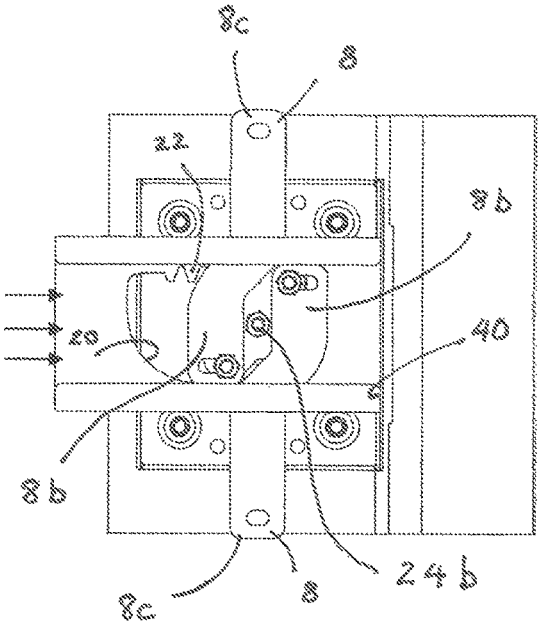
FIG. 2B is a rear plan view of the locking system of FIG. 1, shown in a second condition in which the system is in an unlocked condition.
Figure 3:
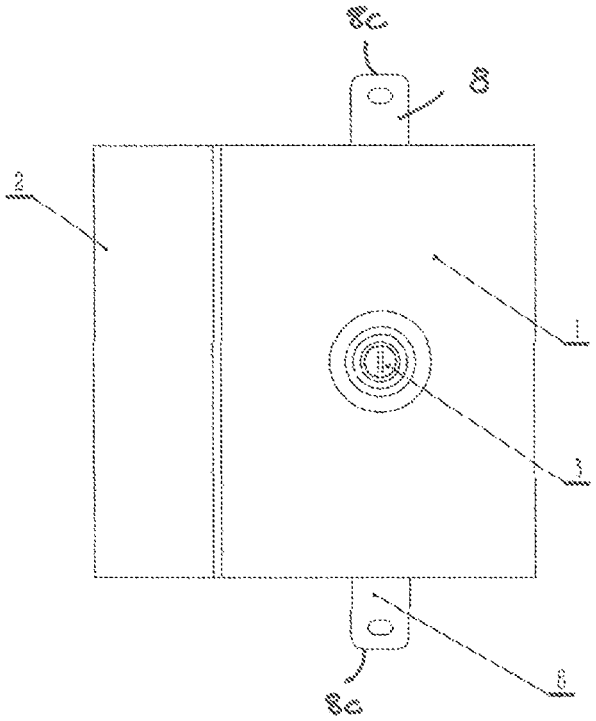
FIG. 3 is a front view of the locking system of FIG. 1, seen from outside a door.
Figure 4:
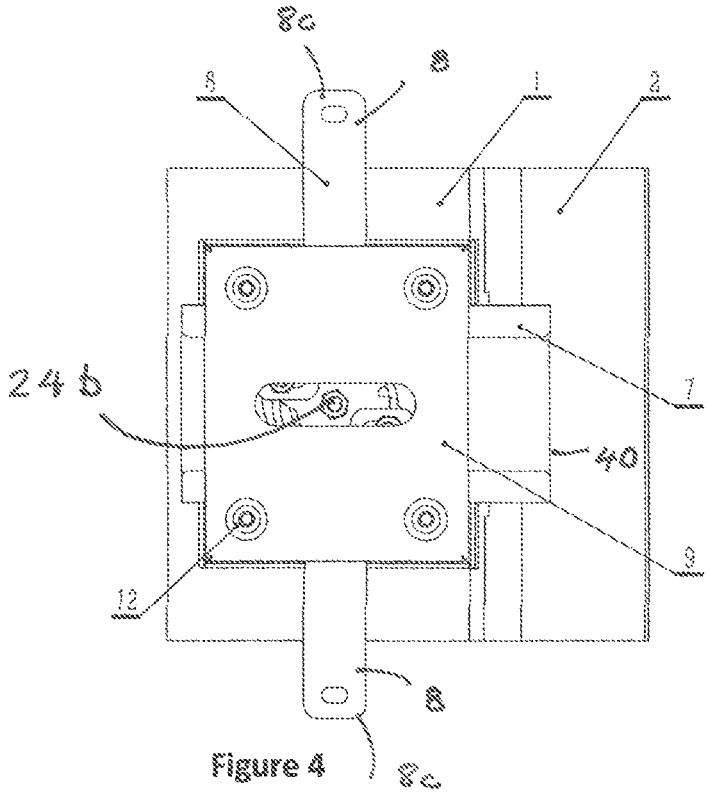
FIG. 4 is a back plan view of the locking system as shown in FIG. 2A, and including a cover plate.
Figure 5:
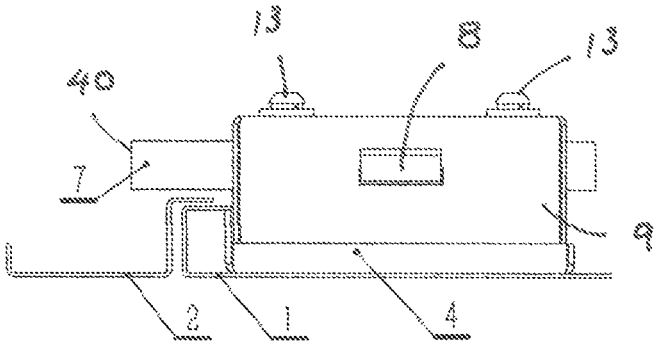
FIG. 5 is a bottom view of the system as shown in FIG. 4
Figure 6:
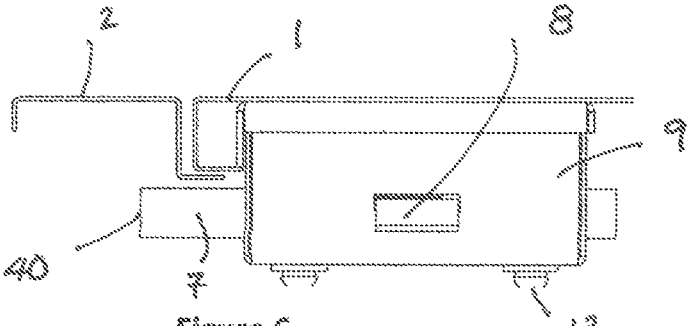
FIG. 6 is a top view of the system as shown in FIG. 4.
Figure 7:
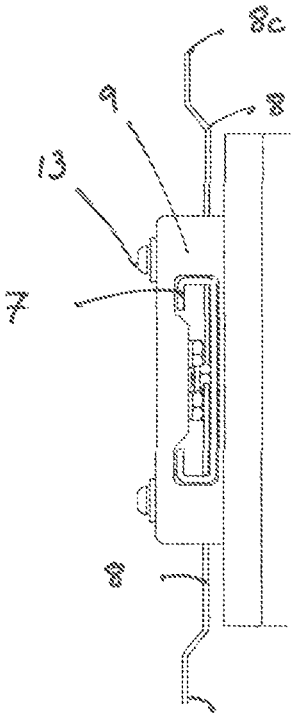
FIG. 7 is a left view of the system as shown in FIG. 4.
Figure 8:
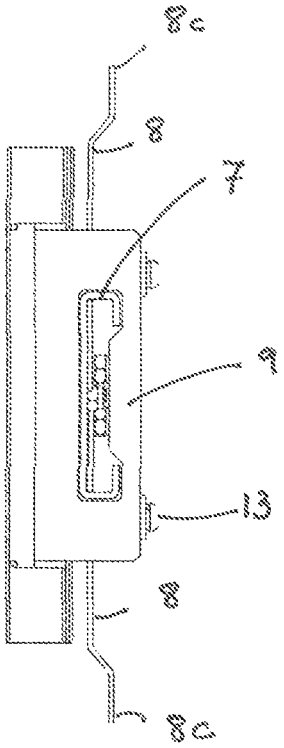
FIG. 8 is a right view of the system as shown in FIG. 4.

In order to accomplish the described horizontal movement locking action, the plate 7 is provided with a shaped aperture 20 surrounded by a continuous perimeter. The aperture 20 has one perimeter portion which extends horizontally, and this portion is provided with teeth 22—as shown in FIGS. 2A and 2B.

A central axis of the aperture 20, extending perpendicular to the plate, 7 is aligned to be co-axial with a key tumbler 3. An axle 24 extends from the key tumbler 3, through an aperture in the door 1, and into the aperture 20. At a terminal end of the axle a disc 6 is attached, and positioned to lie within the aperture 20, and in the same plane as the plate 7. The locking system comprises a key axle 24 having an external end 24*c* and an internal end 24*b*. A disc 6 is fixedly mounted at the internal end 24b of the key axle.

In order to support and reinforce the plate 7 in its connection to the door 1, additional structure may be provided for this purpose. An inner reinforcing plate 4 may be provided, and may be riveted or bolted to the door 1 using rivets or bolts 12, 13, 14. An outer reinforcing plate 9 may be provided, and may be hollow to enclose the plate 7. It may be riveted or bolted to the door using the same rivets or bolts 12, 13, 14 so that the plate may become encased between the inner and outer reinforcing plates.

Further structure associated with the locking mechanism 102 may include an upper linking arm 8 and a lower linking arm 8, each attached to the disc 6, each at an interior end, by a pinned connection to the disc 6. By "pinned connection" it is meant in this application that a first element, connected to a second element by "pinned connection," allows the first element to rotate in relation to the second element.

At an exterior end of each linking arm 8, the arms may be attached by operable connection to a respective connecting rod 28 at an interior end of the connecting rod. ("Operable connection" is used herein to mean that when two elements are operably connected to each other, then movement of the first element will cause the second element to move, but that a direct connection between the two is not required. Intermediate elements may also be included.) Each connecting rod 28 is operably connected at a respective outer end to one an inner end of each respective vertical pin 15. Thus, an upper linking arm 8 and a lower linking arm 8 are provided, wherein a first end 8*b* of the upper linking arm is attached by pinned connection to the disc 6 and a first end 8*b* of the lower linking arm is attached by pinned connection to the disc 6. An upper locking pin 15 and a lower locking pin 15 are provided, wherein a second end 8*c* of the upper linking arm 8 is operably connected to the upper locking pin 15, and a second end 8c of the lower linking arm 8 is operably connected to the lower locking pin 15.

The disc 6 is provided on its external perimeter with teeth 26 which are shaped to mate with the teeth 22 on the internal perimeter of the aperture 20.

Operation.

Thus, in use, when the key axle 24 is rotated by a key (key not shown in the figures), the disc 6 is rotated, thereby causing the external end of the plate 7 (via the mating sets of teeth 22, 26) to move horizontally—either outwards away from the center of the door 1 or inwards towards the center of the door 1, depending on the direction the key is rotated. When the horizontal plate moves horizontally outwards, its distal end moves away from the door 1 and slides into a circumscribed aperture in the vertical post of the frame of the safe. This action thus provides a secure lock at the center of the door. Due to the fact that the distal end 30 of the plate is inserted into a circumscribed aperture in the post, a strength advantage is provided over an aperture that includes a cantilevered portion of metal.

In further operation, simultaneously with the plate 7 moving horizontally, each linking arms 8 is forced to move in the vertical direction—either upwards, alternately downwards, depending on which of the two linking arms 8, and on whether the disc 6 is rotated clockwise or counter clockwise. The arms 8 in turn move the rods 28 up or down, and these move the pins 15 up or down. Thus, rotation of the key moves the external extremities of three locking elements away from, or alternatively, towards, the door 1. As a consequence, each external extremity of the locking elements then either enters a circumscribed aperture in the frame of the safe, or is withdrawn from such aperture.

Accordingly, the present invention addresses problems in the art, including those that are described above.

Although the inventions have been described with reference to preferred embodiments, which should be construed in an illustrative and not limiting sense, it will be appreciated by one of ordinary skill in the art that numerous modifications are possible in light of the above disclosure. For example, the locking mechanisms, pins and other structures described herein may be equally applicable to safe doors, vault doors and any other type of door for which added security is desired. All such variations and modifications are intended to be within the scope and spirit of the invention.

Although preferred illustrative variations of the present invention are described above, it will be apparent to those skilled in the art that various changes and modifications may be made thereto without departing from the invention. For example, it will be appreciated that combinations of the features of different embodiments may be combined to form another embodiment. Furthermore, although in the described embodiments the apparatus and methods are for conducting in a blood vessel, it should be understood that treatment alternatively may be conducted in other body lumens. It is intended in the appended claims to cover all such changes and modifications that fall within the true spirit and scope of the invention.

I claim:

1. A locking system for securing, within a rectangular frame aperture of a safe, a hinged door having a perimeter and an external side and an internal side and occupying a first vertical plane, the door being configured for suspension on hinges, the locking system comprising:

a key axle having an external end and an internal end, and extending through an aperture in the door perpendicularly to the vertical plane;

a disc occupying a second vertical plane, and being fixedly mounted at the internal end of the key axle, the disc having a first external perimeter defining a first set of teeth;

a plate occupying a third vertical plane and mounted to the internal side of the door such as to allow the plate to slide horizontally and extend a distal end of the plate towards beyond the door perimeter, wherein the plate defines an aperture surrounded by a second internal perimeter sized to receive, and which does receive, the first external perimeter of the disc, and wherein the second vertical plane of the disc lies within the aperture so that the second vertical plane is co-planar with the third vertical plane;

wherein a portion of the second internal perimeter defines a second set of teeth configured to mate with the first set of teeth;

an upper linking arm and a lower linking arm, wherein a first end of the upper linking arm is attached by pinned connection to the disc and a first end of the lower linking arm is attached by pinned connection to the disc;

an upper locking pin and a lower locking pin, wherein a second end of the upper linking arm is operably connected to the upper locking pin, and a second end of the lower linking arm is operably connected to the lower locking pin;

whereby, when the key axle is rotated the disc is caused to rotate and (a) the first set of teeth engage with the second set of teeth so that the plate slides horizontally to extend the distal end of the plate towards beyond the door perimeter, and (b) the upper linking arm and the lower linking arm are caused to move away from the disc, thereby to extend the upper locking pin and the lower locking pin towards beyond the door perimeter.

2. The locking system of claim 1, wherein the locking system is encased between an inner reinforcing plate and an outer reinforcing plate.

3. The locking system of claim 2, wherein the inner reinforcing plate and the outer reinforcing plate respectively are each riveted to the door.

4. The locking system of claim 1 wherein the upper locking pin and the lower locking pin respectively each pass through an aperture formed in a horizontally extending stabilizing plate that is attached to the door.

* * * * *